US006883992B2

(12) United States Patent
Pauchet

(10) Patent No.: US 6,883,992 B2
(45) Date of Patent: Apr. 26, 2005

(54) RESERVOIR AND APPLICATOR SYSTEM

(75) Inventor: Bernard Pauchet, Saint Capraise de Lalinde (FR)

(73) Assignee: Taiki Corporation, Ltd., Osaka (JP)

( * ) Notice: Subject to any disclaimer, the term of this patent is extended or adjusted under 35 U.S.C. 154(b) by 0 days.

(21) Appl. No.: 10/276,297

(22) PCT Filed: May 30, 2001

(86) PCT No.: PCT/FR01/01674

§ 371 (c)(1),
(2), (4) Date: Nov. 22, 2002

(87) PCT Pub. No.: WO01/91599

PCT Pub. Date: Dec. 6, 2001

(65) Prior Publication Data

US 2003/0123920 A1 Jul. 3, 2003

(30) Foreign Application Priority Data

May 31, 2000 (FR) ..... 00 06985

(51) Int. Cl.[7] ..... B43M 11/06; B43K 1/06; B05C 11/00

(52) U.S. Cl. ..... 401/183; 401/265; 401/266

(58) Field of Search ..... 401/263, 265, 401/266, 132, 183, 185; 408/1 R, 19, 219

(56) References Cited

U.S. PATENT DOCUMENTS 931,526 A * 8/1909 Turner et al. ..... 408/219
2,921,324 A * 1/1960 Gibbons ..... 401/263
4,211,501 A * 7/1980 Pedroso et al. ..... 401/261
5,353,819 A 10/1994 Kahn et al.
5,415,504 A * 5/1995 Wolf et al. ..... 408/204
5,577,851 A * 11/1996 Koptis ..... 401/202
6,325,565 B1 * 12/2001 Girardot et al. ..... 401/266
6,386,781 B1 5/2002 Gueret
6,432,007 B1 * 8/2002 Filice et al. ..... 473/566

FOREIGN PATENT DOCUMENTS

GB 1528677 10/1978

* cited by examiner

*Primary Examiner*—David J. Walczak
(74) *Attorney, Agent, or Firm*—Richard M. Goldberg

(57) ABSTRACT

A reservoir and applicator system suitable for containing a composition of the cosmetic composition includes a single element (10) of compressible material in which a reservoir-forming cavity (12) is formed suitable for receiving the composition. The single element (10) presents both a first end (14) and a second end (18) forming the applicator, the application surface (20) thereof being constituted by the outside wall of the second end (18). The cavity (12) is extended by a channel (16) opening out into the second end (18) such not the composition can be transferred from the reservoir to the application surface (20) in order to be applied.

9 Claims, 2 Drawing Sheets

RESERVOIR AND APPLICATOR SYSTEM

The present invention relates to a reservoir and applicator system suitable for containing a composition such as a cosmetic composition and suitable for enabling it to be applied to the surface of the skin.

The system is intended particularly, but not exclusively, for containing samples of cosmetic compositions in liquid or paste form.

When commercially promoting cosmetic compositions, it is necessary to provide samples that can be given away in stores or for trying out by clients at points of sale. Such samples of compositions are generally produced by hermetically enclosing a composition between two plastic-coated sheets that are heat-sealed together. In order to open the reservoir-forming sachet easily and in order to enable the composition to be applied, a notch is generally formed in the heat-sealed portion so as to enable a portion of the reservoir to be torn.

When the sample is used, a portion of the sachet is torn open and the sachet is then squeezed to extract the composition which is applied to the skin with the fingers or with a pad.

Generally, daily application of a cosmetic composition, e.g. on the face, is performed in a location where it is easy to wash the fingers after applying the composition. In contrast, if a sample is used at a point of sale for cosmetics, that facility is not available and as a result it is necessary to wipe the fingers by means of a paper tissue, for example. In addition, applying the composition with a pad assumes that samples and pads are available simultaneously.

A first object of the present invention is to provide a system comprising a reservoir and an applicator secured to said reservoir so as to avoid the need to apply the composition with the fingers or to use an auxiliary applicator.

According to the invention, this object is achieved by a reservoir and applicator system suitable for containing a composition of the cosmetic composition type that is characterized in that it comprises a single element of compressible material in which a reservoir-forming cavity is formed suitable for receiving said composition, said single element presenting both a first end and a second end forming said applicator and having an application surface constituted by the outside wall of said second end, and in that said cavity is extended by a channel opening out into said second end, whereby said composition can be transferred from said reservoir to said application surface in order to be applied.

Thus, since the reservoir and the applicator form a single element there is no longer any need to have an auxiliary applicator or to apply said composition to the skin using the fingers. As explained in greater detail below, said single element of compressible material presents an outside surface with properties that are compatible with the surface of the skin and with applying a cosmetic composition. In particular, it will be understood that rubbing the applicator against the skin must provide a sensation of softness or must at least avoid providing any sensation that is disagreeable.

An essential characteristic of the invention is thus to use a material which presents simultaneously the leakproof proprieties needed for storing said composition and the surface properties needed for applying said composition to the skin. Furthermore, once the reservoir has been formed and it is full, the end of said channel opening out into said second end must be easy to open.

For this purpose, in a first preferred implementation of the invention, said second end further comprises a peel-off protection piece on said application surface suitable for protecting and closing said channel.

Thus, the channel opening out directly into the application surface is closed by said protection piece which also protects the application surface from dust. It will be understood that in use the protection piece is unstuck from the second end and that the composition of the reservoir is extracted and brought to the application surface by applying pressure on said single element.

In a second preferred implementation of the invention, said second end forming said applicator is suitable for being cut so as to open said channel and reveal said application surface. In this embodiment, the application surface appears when cutting the second end of said single element, said cut also opening the channel which extends at least to the plane of cut.

Advantageously, said channel is extended so as to open out also in said first end, such that said composition can be inserted into said reservoir through said first end, and said first end further comprises a plug-forming element suitable for closing said reservoir. The single element thus presents an open first end corresponding to the extension of the reservoir, suitable for being closed by a plug after the reservoir has been filled. As explained below, the plug-forming element is generally sealed irreversibly on the first end of the single element since the assembly is generally discarded after first use.

Preferably, said single element of compressible material is cylindrical in shape and is constituted by polyurethane foam. This material presents surface properties suitable for enabling it to be applied to the skin and intrinsic compressibility and impermeability properties corresponding to the intended application.

Furthermore, and advantageously, said second end is defined by a plane that is not orthogonal to the longitudinal axis of said single element so as to increase the area of the application surface of said applicator.

In a second aspect, the present invention provides a method of making a reservoir and applicator system suitable for containing a composition of the cosmetic composition type, the method comprising the following steps:

providing a single element of compressible material having a first end and a second end;

drilling said single element longitudinally so as to form a reservoir-forming cavity; and drilling said single element longitudinally so as to form a channel extending said cavity and opening out into said second end, whereby said composition can be inserted and/or extracted via said channel.

Thus, a characteristic of the method lies in making the reservoir and the applicator from a single element in which the reservoir-and-channel forming cavities are formed. The single element is drilled axially so as to provide a reservoir-forming cavity and so as to form a channel of smaller diameter which extends the reservoir and opens out into the second end.

In a preferred implementation of the second aspect of the present invention, the method of making the reservoir and applicator system is characterized in that it comprises the following steps:

compressing said single element perpendicularly to its longitudinal axis in at least a portion of its volume; and using a drilling tool of constant diameter to drill said single element longitudinally at least in said compressed portion of its volume so as to obtain, after ceasing to compress said single element, a cavity of diameter greater that the diameter of said channel which extends the cavity and which opens out into said second end.

When said single element is compressed, the density of material in the compressed volume is greater than the density in the other volumes that are not compressed, and when the compressed volume is drilled, the quantity of matter that is extracted is thus greater than the quantity of matter that is extracted from the other volumes. Thus, when said element returns to its initial shape, the previously compressed cavity is larger than the cavity made in the non-compressed volumes. This disposition makes it possible to use a drill bit of constant diameter to drill both the reservoir and the channel extending it.

In another preferred implementation, the method of making the reservoir and applicator system is characterized in that a drilling tool presenting a first portion of smaller diameter than the diameter of a second portion is used to drill said single element longitudinally from said first end so as to form simultaneously said channel opening out into said second end and said reservoir opening out into said first end.

According to this characteristic, the reservoir is drilled on a single occasion by a drill bit having two portions of different diameters so as to drill both the reservoir and the channel which extends it. As explained in greater detail below, this characteristic of the method presents an advantage when the reservoir is filled from the first end of said single element.

Other features and advantages of the invention appear on reading the following description of particular embodiments of the invention given by way of non-limiting indication, and with reference to the accompanying/drawings, in which.

Figure 1:
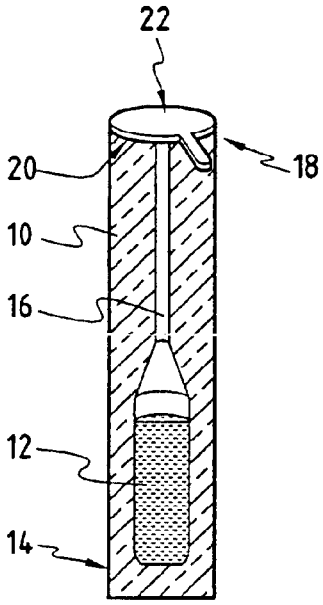
FIG. 1 is a longitudinal section view showing the reservoir and applicator system constituting a first embodiment.

Reference is made initially to FIG. 1 while describing the essential elements constituting the reservoir and applicator system in accordance with the invention.

In FIG. 1, the reservoir and applicator system is shown vertically, being constituted by a single element of compressible material 10 that is of generally cylindrical shape. The compressible material is a polyurethane foam or a polyethylene foam. These closed-cell foams are selected for their flexibility, their compressibility, and also for their high degree of softness to the touch. This characteristic is important given that said single element is to be applied to the face and it should preferably provide a sensation that is agreeable.

Closed-cell foams present the advantage of being impermeable. Thus, they are suitable for hermetically containing compositions in liquid or paste form.

In FIG. 1, the single element 10 presents a reservoir-forming cavity 12 whose base is situated close to the first end 14 of the single element 10 and it contains a composition of the cosmetic composition type. The cavity 12 is extended by a channel 16 opening out in the second end 18 of the single element 10 which constitutes the applicator.

The second end 18 forming the applicator presents an application surface 20 into which the channel 18 opens out and on which a protection piece 22 is stuck. The protection piece 22 is constituted by a peel-off sticky label having the dual functions of protecting the application surface 20 and of closing the channel 16.

When the reservoir and applicator system is used, the protection piece 22 is peeled off the application surface 20 and pressure is applied to the single element so as to expel the composition from the reservoir. At least a fraction of the composition is transferred via the channel 16 to the application surface 20, and by holding the applicator-forming second end 18 so as to bring the application surface 20 against the skin, the composition can be spread by moving the second end 18 in a plane parallel to the mean plane of the surface of the skin.

Figure 2:
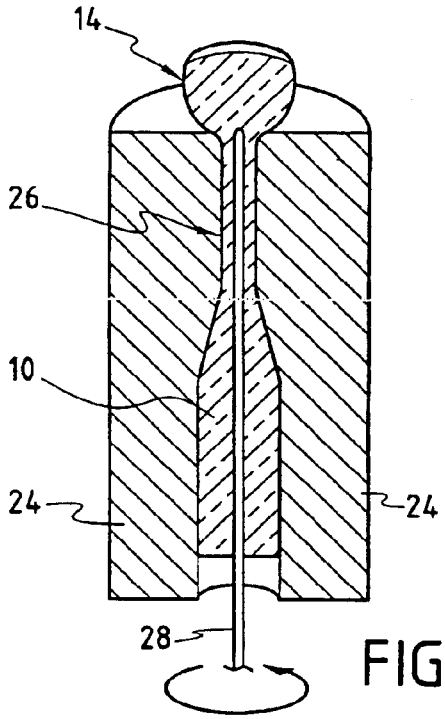
FIG. 2 is a fragmentary longitudinal section view showing a step in making the system of the first embodiment.

Reference is now made to FIG. 2 while describing the method of making the reservoir and applicator system as described above.

In FIG. 2, the single element of compressible material 10 is held in a jaw-forming device 24 which compresses it perpendicularly to its longitudinal axis in a bottom portion 26, close to the first end 14. Thereafter, the single element 10 is drilled longitudinally along its main axis from its second end by means of a drilling tool 28. The single element 10 is thus drilled along its entire length, including the bottom portion 26, but with the exception of the first end 14. Naturally, drilling is performed in the central portion of the single element 10 and at a distance that is far enough away to enable its outside surface to constitute a strong wall that is impermeable to the composition that is to be introduced into the inside of the cavity.

The drilling tool 28 may have helical threads with sharp edges and it may be rotated so as to drill the single element 10, however it could also be a piece that is heated, thereby performing drilling by burning the foam.

Figure 3:
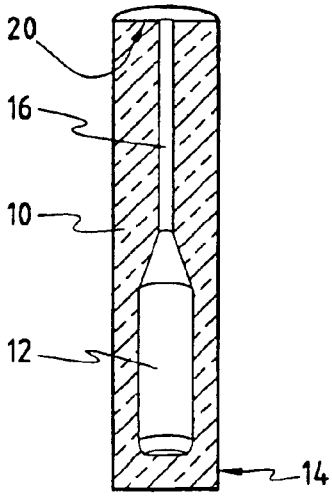
FIG. 3 is a longitudinal section view showing the reservoir and applicator system as obtained after transforming the single element using the step shown in FIG. 2.

Once drilling has been performed, the single element 10 is released from the jaw-forming device 24 and presents the shape shown in FIG. 3. The cavity 12 corresponds to the bottom portion 26 which was compressed and from which larger quantities of material have been removed because of the compression. Thus, the cavity 12 is larger than the top cavity 16 which corresponds to a non-compressed portion and which thus forms the channel.

In the method, the reservoir and the channel are made in a single operation using a drilling tool of constant diameter, which means that the method is simplified.

Thereafter, the cosmetic composition is inserted under pressure through the channel 16 which opens out into the application surface 20 by means of a pipette or a small-diameter pipe so as to fill the reservoir 12. The reservoir and applicator system is closed by sticking a label onto the application surface 20.

Figure 4:
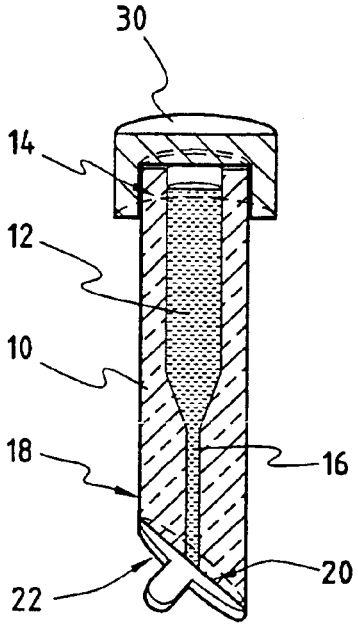
FIG. 4 is a longitudinal section view showing the reservoir and applicator system constituting a second embodiment.

Reference is now made to FIG. 4 while describing the elements constituting a reservoir and applicator system in another embodiment.

In FIG. 4, there can be seen the single element 10 in which the reservoir-forming cavity 12 is formed that is extended by the channel 16. However, the cavity 12 extends so as to open out in the first end 14 of the single element 10. The cavity 12 that is open in this way is closed by means of a plug-forming element 30 fixed to the outside surface of the first end 14.

The plug-forming element 30 also constitutes means for enabling the system to be stood upright on a surface. Furthermore, it provides a good support onto which any label can be stuck for informing the user about the nature of the composition.

Naturally, the plug-forming element could equally well be inserted in the extension of the cavity 12 in order to close it, but then it would not form the functions mentioned above.

In addition, the second end 18 of the single element 10 is defined by a plane that is not orthogonal to the axis of the single element 10. This configuration makes it possible to obtain a second end 18 that forms an applicator whose application surface 20 is of larger area than when using a surface that is orthogonal. In some cases increasing the application surface area improves application of the composition on the skin without making it necessary to have recourse to another applicator.

As in the first embodiment, the channel 16 is closed by a protection piece 22 covering the application surface 20 and which is naturally of a different shape.

Naturally it would not go beyond the ambit of the invention for the general shape of the single element to be other than cylindrical, for example square, with that giving rise to a different shape for the application surface.

Figure 5:
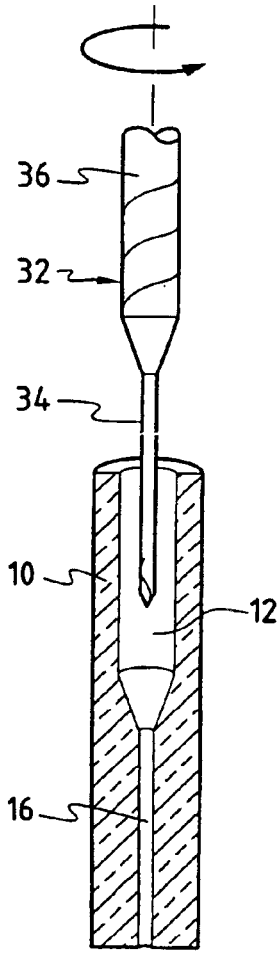
FIG. 5 is a longitudinal section view showing a step in making the system as shown in FIG. 4.

Reference is made to FIG. 5 while describing the method of making the reservoir and applicator system as described above.

In this embodiment, the single element 10 is drilled longitudinally along its entire length by means of a drilling tool 32 presenting two portions of different diameters. At its end, the tool 34 is finer and serves to form the channel 16 which opens out into the second end 18 of the single element 10. Simultaneously, the reservoir 12 is formed by the body 36 of the tool which also passes through the first end 14 of the single element 10.

In this embodiment, the tool may equally well be a drill bit or a hot piece.

Prior to filling the reservoir from the first end 14, the second end 18 into which the channel 16 opens out is covered by the peel-off protection piece so as to close the channel 16. Thereafter, the reservoir is filled and is then closed by the plug-forming element.

Figure 6:
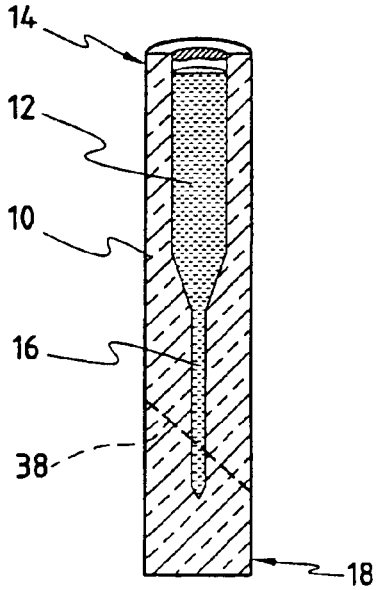
FIG. 6 is a longitudinal section view showing the reservoir and applicator system of the invention in a third embodiment.

The method of making the reservoir and applicator system as described above is suitable for being implemented to make a reservoir and applicator system in accordance with the invention that constitutes another particular embodiment as shown in FIG. 6.

FIG. 6 shows the single element of compressible material 10 in which the reservoir 12 is dug out, the reservoir extending through the first end 14 and being closed by the plug-forming element 30. The reservoir 12 is also extended by a channel 16 that opens out in the second end 18. The end of the channel 16 is blind and does not open to the outside of the single element 10. In contrast, the second end 18 has a cut starter 38 lying in a section plane that intersects said channel 16. Thus, once the second end 18 has been cut, the channel 16 opens out into an application surface corresponding to the section plane. The composition is extracted and applied in the same manner as in the preceding embodiments.

It will be understood that the intrinsic properties of the foam must be uniform throughout the bulk of the single element since the section surface must have the same surface properties as those of the initial surface of the single element.

The reservoir and applicator system constituting this particular embodiment can be made using the method described above.

For this purpose, using a drilling tool having a first portion of smaller diameter than a second portion, the single element is drilled from the first end but without passing right through the element so as to drill a channel in the second end which remains blind. Thereafter, a cut starter is formed in the second end so as to enable it to be cut.

What is claimed is:

1. A reservoir and applicator system for containing a cosmetic type composition, said system comprising:

a single unitary, generally elongated cylindrical element made of a compressible material and including:

a longitudinal axis, an external lateral face which is generally cylindrical along a length thereof, a first end, and an applicator surface formed entirely by an outside wall of a second opposite end of the single element, a reservoir-forming cavity formed within said element for holding said composition, said cavity having a cavity opening dimension measured in a direction transverse to said longitudinal axis, and a channel formed within said element and extending to said cavity, said channel opening out into said second end and having a section with a channel opening dimension measured in said transverse direction which is less than said cavity opening dimension, whereby said composition can be transferred from said reservoir-forming cavity to said application surface in order to be applied.

2. A reservoir and applicator system according to claim 1, further comprising a peel-off protection piece on said application surface at said second end for protecting and closing said channel.

3. A reservoir and applicator system according to claim 1, wherein said second end is suitable for being cut so as to open said channel and reveal said application surface.

4. A reservoir and applicator system according to claim 1, wherein said cavity is extended so as to open out in said first end such that maid composition can be inserted into said reservoir-forming cavity through said first end, and further comprising a plug-forming element for closing said reservoir-forming cavity at said first end.

5. A reservoir and applicator system according to claim 1, wherein said compressible material is polyurethane foam.

6. A reservoir and applicator system according to claim 5, wherein said second end is defined by a plane that is not orthogonal to said longitudinal axis of said single element so as to increase the area of the application surface of said applicator.

7. A method of making a reservoir and applicator system for containing a cosmetic type composition, the method comprising the steps of:

a) providing a single, unitary generally elongated cylindrical element of compressible material having a first end, and a second opposite end having an applicator surface formed entirely by an outside wall of the second opposite end, a longitudinal axis, and an external lateral face which is generally cylindrical along a length thereof;

b) drilling said single element longitudinally so as to form a reservoir-forming cavity for holding the composition, such that said cavity has a cavity opening dimension measured in a direction transverse to said longitudinal axis; and c) drilling said single element longitudinally so as to form a channel extending from said cavity and opening out into said second end such that at least a section of the channel has a channel opening dimension measured in said transverse direction which is less than said cavity opening dimension, whereby said composition can be inserted and/or extracted via said channel.

8. A method of making a reservoir and applicator system according to claim 7, wherein steps b) and c) include the steps of:

compressing said single element perpendicularly to a longitudinal axis thereof in at least a portion of its volume; and using a drilling tool of constant diameter to drill said single element longitudinally at least in said compressed portion of its volume so as to obtain, after ceasing to compress said single element, a cavity of diameter greater than the diameter of said channel which extends to the cavity and which opens out into said second end.

9. A method of making a reservoir and applicator system according to claim 7, wherein steps b) and c) include the step of drilling with a drilling tool presenting a first portion of smaller diameter than the diameter of a second portion said single element longitudinally from said first end so as to form simultaneously said channel opening out into said second end and said reservoir-forming cavity opening out into said first end.

* * * * *